US009958189B2

(12) United States Patent
Ryu et al.

(10) Patent No.: US 9,958,189 B2
(45) Date of Patent: May 1, 2018

(54) AIR CONDITIONER

(71) Applicant: LG ELECTRONICS INC., Seoul (KR)

(72) Inventors: Byoungjin Ryu, Seoul (KR); Younghwan Ko, Seoul (KR); Byeongsu Kim, Seoul (KR); Beomchan Kim, Seoul (KR); Baikyoung Chung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 117 days.

(21) Appl. No.: 14/992,618

(22) Filed: Jan. 11, 2016

(65) Prior Publication Data

US 2016/0201954 A1 Jul. 14, 2016

(30) Foreign Application Priority Data

Jan. 12, 2015 (KR) ..... 10-2015-0004280

(51) Int. Cl.

| | |
|---|---|
| ***F25B 30/02*** | (2006.01) |
| ***F25B 31/02*** | (2006.01) |
| ***F25B 41/04*** | (2006.01) |
| ***F25B 1/04*** | (2006.01) |

(Continued)

(52) U.S. Cl.

CPC ..... *F25B 30/02* (2013.01); *F25B 1/04* (2013.01); *F25B 1/10* (2013.01); *F25B 13/00* (2013.01); *F25B 31/026* (2013.01); *F25B 41/043* (2013.01); *F25B 41/046* (2013.01);

(Continued)

(58) Field of Classification Search

CPC ..... F25B 30/02; F25B 1/10; F25B 41/046; F25B 31/026; F25B 41/043; F25B 1/04; F25B 2600/2509; F25B 45/00

See application file for complete search history.

(56) References Cited

U.S. PATENT DOCUMENTS 4,293,092 A * 10/1981 Hatz ..... F24H 4/02 122/26
5,899,091 A * 5/1999 Fraser, Jr. ..... F25B 31/002 62/473

(Continued)

FOREIGN PATENT DOCUMENTS

EP 1 983 275 A1 10/2008
EP 2 357 427 A1 8/2011

(Continued)

*Primary Examiner* — Emmanuel Duke
(74) *Attorney, Agent, or Firm* — Dentons US LLP

(57) ABSTRACT

An air conditioner is provided. The air conditioner includes a compressor having a suction unit and a plurality of injection inlets, an inside heat exchanger into which refrigerant compressed in the compressor is introduced during a heating operation, an outside heat exchanger into which refrigerant compressed in the compressor is introduced during a cooling operation, a plurality of refrigerant separation devices through which refrigerant condensed in the inside heat exchanger or the outside heat exchanger pass, a plurality of injection flow paths which extends from the three refrigerant separation devices to the plurality of injection inlets, and a bypass flow path which extends from any one injection flow path among the plurality of injection flow paths to the suction unit of the compressor.

19 Claims, 8 Drawing Sheets

(51) Int. Cl.
*F25B 1/10* (2006.01)
*F25B 13/00* (2006.01)

(52) U.S. Cl.
CPC . *F25B 2313/02741* (2013.01); *F25B 2400/13* (2013.01); *F25B 2600/2509* (2013.01)

(56) References Cited

U.S. PATENT DOCUMENTS

| | | | | |
|---|---|---|---|---|
| 2011/0113808 | A1* | 5/2011 | Ko | F25B 1/04 62/324.3 |
| 2012/0125024 | A1* | 5/2012 | Ryu | F25B 40/02 62/115 |
| 2012/0186295 | A1* | 7/2012 | Yoon | F25B 1/10 62/510 |
| 2013/0055754 | A1* | 3/2013 | Kim | F25B 1/10 62/510 |
| 2013/0219927 | A1* | 8/2013 | Kim | F25B 30/02 62/77 |
| 2014/0305150 | A1* | 10/2014 | Kim | F25B 41/04 62/115 |

FOREIGN PATENT DOCUMENTS

| | | | |
|---|---|---|---|
| EP | 2 631 563 | A1 | 8/2013 |
| JP | 2002-188865 | A | 7/2002 |
| KR | 10-2013-0096831 | A | 9/2013 |
| KR | 10-1382007 | B1 | 4/2014 |
| WO | 2008/143611 | A1 | 11/2008 |
| WO | 2010/077812 | A1 | 7/2010 |
| WO | 2013/019072 | A2 | 2/2013 |

* cited by examiner

AIR CONDITIONER

CROSS-REFERENCE TO RELATED APPLICATION(S)

This application claims priority under 35 U.S.C. § 119 to Korean Patent Application No. 10-2015-0004280, filed on Jan. 12, 2015, the entire disclosure of which is incorporated herein by reference.

BACKGROUND

1. Field

An air conditioner is disclosed herein.

2. Description of the Related Art

Air conditioners are appliances for maintaining a desired air temperature in a room. For example, the air conditioner may operate to cool the room, heat the room, and adjust the humidity in the room. Specifically, the air conditioner drives a refrigeration cycle in which compression, condensation, expansion, and evaporation of a refrigerant are performed, and thus may perform a cooling or heating operation for the room.

The air conditioner may be either a separate-type air conditioner in which an inside unit and an outside unit are separated, or an integrated air conditioner in which the inside unit and the outside unit are combined. The outside unit typically includes an outside heat exchanger which exchanges heat with outside air, and the inside unit typically includes an inside heat exchanger which exchanges heat with the inside air. The air conditioner may be operated in a cooling mode or a heating mode.

When the air conditioner is operated in the cooling mode, the outside heat exchanger functions as a condenser, and the inside heat exchanger functions as an evaporator. On the other hand, when the air conditioner is operated in the heating mode, the outside heat exchanger functions as an evaporator, and the inside heat exchanger functions as a condenser.

Generally, when an outside air temperature where the air conditioner is installed is higher or lower than a set temperature, a sufficient amount of refrigerant circulation should be ensured in order to obtain the desired cooling and heating performance. This generally requires a large capacity compressor, which is costly to manufacture and install.

To solve this problem, systems have been developed whereby refrigerant is injected inside a scroll compressor using a refrigerant injection flow path. See, e.g., Korean Application No. 10-1280381. For example, as described in Korean Application No. 10-1280381, first and second refrigerant injection ports are formed. The ports allow refrigerant to be injected twice while the refrigeration cycle is operated. However, when the outside air temperature is very high or low, it is difficult to obtain the sufficient amount of refrigerant circulation in order to ensure the desired cooling and heating performance using only two injections.

BRIEF DESCRIPTION OF THE DRAWINGS

Embodiments will be described in detail with reference to the following drawings in which like reference numerals refer to like elements, and wherein.

DETAILED DESCRIPTION

Hereinafter, embodiments will be described in detail with reference to the accompanying drawings. The embodiments may, however, be embodied in many different forms and should not be construed as being limited to the embodiments set forth herein; rather, alternate embodiments falling within the spirit and scope will fully convey the concept to those skilled in the art.

Figure 1:
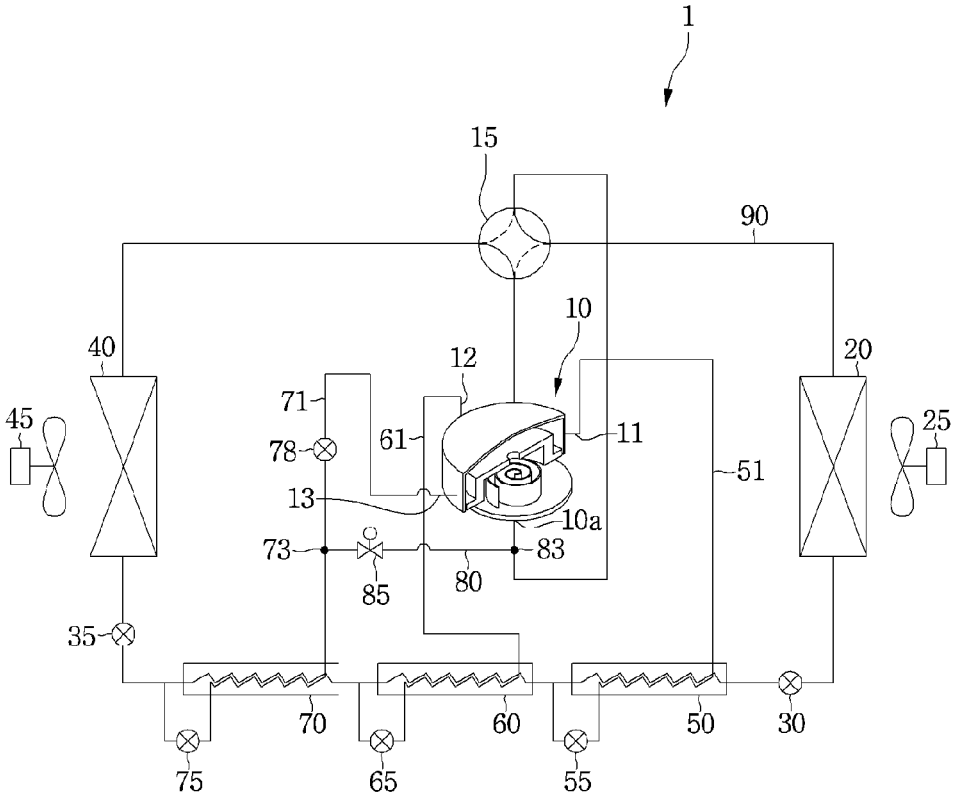
FIG. 1 is a system diagram illustrating a configuration of an air conditioner according to a first embodiment.

FIG. 1 is a system diagram illustrating an air conditioner according to a first embodiment.

Referring to FIG. 1, an air conditioner 1 according to a first embodiment drives a refrigeration cycle in which a refrigerant circulates. The air conditioner 1 may perform a cooling or heating operation according to a direction of circulation of the refrigerant.

Air conditioner 1 includes a compressor 10 to compress the refrigerant, a flow path switching unit 15 to switch a flow direction of the refrigerant discharged from the compressor 10 according to the cooling operation or the heating operation, an outside heat exchanger 20 or an inside heat exchanger 40 to condense the refrigerant compressed in compressor 10, a first expansion device 30 and a second expansion device 35, which are provided between outside heat exchanger 20 and inside heat exchanger 40, to expand the refrigerant, and a refrigerant pipe 90 to connect these components and guide a flow of the refrigerant.

Air conditioner 1 further includes an outside fan 25 which is installed at one side of outside heat exchanger 20 and blows outside air toward outside heat exchanger 20, and an inside fan 45 which is installed at one side of inside heat exchanger 40 and blows inside air toward inside heat exchanger 40.

When air conditioner 1 performs the cooling operation, the refrigerant is compressed in the compressor 10 and then condensed in the outside heat exchanger 20 via flow path switching unit 15. The refrigerant is then expanded in second expansion device 35 and then is evaporated in inside heat exchanger 40.

Alternatively, when air conditioner 1 performs the heating operation, the refrigerant is compressed in compressor 10 and then is condensed in inside heat exchanger 40 via flow path switching unit 15. The refrigerant is then expanded in first expansion device 30, and then is evaporated in outside heat exchanger 20.

Thus, during a cooling operation, outside heat exchanger 20 operates as a condenser and inside heat exchanger 40 operates as an evaporator, and during a heating operation, inside heat exchanger 40 operates as a condenser and outside heat exchanger 20 operates as an evaporator.

Hereinafter, an example of a case in which air conditioner 1 performs the cooling operation will be described.

Compressor 10 is configured to be multi-stage compressed. For example, compressor 10 may include a scroll compressor to compress the refrigerant by a relative phase difference between a fixed scroll and an orbiting scroll.

Air conditioner 1 includes a plurality of internal heat exchangers 50, 60, and 70 to supercool the refrigerant that is passed through the condenser.

For example, in the case of the cooling operation, the plurality of internal heat exchangers 50, 60, and 70 includes a first internal heat exchanger 50 to supercool the refrigerant that is passed through outside heat exchanger 20, a second internal heat exchanger 60 to supercool the refrigerant that is passed through first internal heat exchanger 50, and a third internal heat exchanger 70 to supercool the refrigerant that is passed through second internal heat exchanger 60. First, second, and third internal heat exchangers 50, 60, and 70 may be connected in series. Meanwhile, first, second, and third internal heat exchangers 50, 60, and 70 operate to supercool the refrigerant and thus may be referred to as first, second, and third super cooling devices 50, 60, and 70, respectively.

Air conditioner 1 includes a first injection flow path 51 through which some refrigerant among the refrigerant passed through outside heat exchanger 20 is bypassed to compressor 10, and a first injection expansion unit 55 which is provided in first injection flow path 51 and adjusts an amount of the bypassed refrigerant. The refrigerant may be expanded while passing through first injection expansion unit 55. For example, first injection expansion unit 55 may include an electronic expansion valve (EEV).

The refrigerant bypassed to first injection flow path 51 among the refrigerant passed through outside heat exchanger 20 is referred to as "a first branched refrigerant," and the remaining refrigerant other than the branched refrigerant is referred to as "a main refrigerant." In first internal heat exchanger 50, heat exchange is achieved between the main refrigerant and the first branched refrigerant.

Since the first branched refrigerant is changed into low-temperature and low-pressure refrigerant while passing through first injection expansion unit 55, the first branched refrigerant absorbs heat while exchanging heat with the main refrigerant and the main refrigerant radiates heat to the first branched refrigerant. Therefore, the main refrigerant may be supercooled. Also, the first branched refrigerant passing through first internal heat exchanger 50 may be injected into compressor 10 through first injection flow path 51.

Compressor 10 includes a first injection inlet 11 connected to first injection flow path 51. First injection inlet 11 is provided at a first position of compressor 10.

Air conditioner 1 includes a second injection flow path 61 through which some refrigerant among the main refrigerant passing through first internal heat exchanger 50 is bypassed, and a second injection expansion unit 65 which is provided in second injection flow path 61 and adjusts an amount of the bypassed refrigerant. The refrigerant may be expanded while passing through second injection expansion unit 65. For example, second injection expansion unit 65 may include an EEV.

The refrigerant bypassed to second injection flow path 61 is referred to as "a second branched refrigerant." In second internal heat exchanger 60, heat exchange is achieved between the main refrigerant and the second branched refrigerant.

Since the second branched refrigerant is changed into low-temperature and low-pressure refrigerant while passing through second injection expansion unit 65, the second branched refrigerant absorbs heat while exchanging heat with the main refrigerant and the main refrigerant radiates heat to the second branched refrigerant. Therefore, the main refrigerant may be supercooled. Also, the second branched refrigerant passing through second internal heat exchanger 60 may be injected into compressor 10 through second injection flow path 61.

Compressor 10 includes a second injection inlet 12 connected to second injection flow path 61. Second injection inlet 12 is provided at a second position of the compressor 10. That is, first injection inlet 11 and second injection inlet 12 are connected to different positions of compressor 10.

Air conditioner 1 includes a third injection flow path 71 through which some refrigerant among the main refrigerant passing through the second internal heat exchanger 60 is bypassed, and a third injection expansion unit 75 which is provided in third injection flow path 71 and adjusts an amount of the bypassed refrigerant. The refrigerant may be expanded while passing through third injection expansion unit 75. For example, third injection expansion unit 75 may include an EEV.

The refrigerant bypassed to third injection flow path 71 is referred to as "a third branched refrigerant." In third internal heat exchanger 70, heat exchange is achieved between the main refrigerant and the third branched refrigerant.

Since the third branched refrigerant is changed into low-temperature and low-pressure refrigerant while passing through third injection expansion unit 75, the third branched refrigerant absorbs heat while exchanging the heat with the main refrigerant and the main refrigerant radiates heat to the third branched refrigerant. Therefore, the main refrigerant may be supercooled.

During the heating operation, the third branched refrigerant passing through third internal heat exchanger 70 may be injected into compressor 10 through third injection flow path 71.

Compressor 10 includes a third injection inlet 13 connected to third injection flow path 71. Third injection inlet 13 is provided at a third position of compressor 10. That is, third injection inlet 13 is provided at a different position from first and second injection inlets 11 and 12.

An injection valve 78 may be installed in third injection flow path 71 to selectively inject the refrigerant through third injection flow path 71. The injection valve 78 may be disposed between a branching unit 73 and third injection inlet 13. For example, injection valve 78 may include an EEV.

During the cooling operation, when injection valve 78 is closed, the refrigerant flowing into third injection inlet 13 may be limited and may flow into a bypass flow path 80. On the other hand, during the heating operation, when injection valve 78 is opened, the refrigerant may be injected into third injection inlet 13. In this case, the refrigerant may be decompressed while passing through injection valve 78.

Third injection flow path 71 is connected to the bypass flow path 80 in which the refrigerant which is introduced into third injection flow path 71 bypasses suction unit 10*a* of compressor 10. Specifically, branching unit 73 is provided at one point of third injection flow path 71, and bypass flow path 80 extends from branching unit 73 to suction unit 10*a* of compressor 10. Bypass flow path 80 includes a combining unit 83 connected to suction unit 10*a* of compressor 10.

A bypass valve 85 is installed in bypass flow path 80 to selectively open and close bypass flow path 80. Bypass valve 85 is disposed between branching unit 73 and suction unit 10*a* of compressor 10.

According to the opening and closing state of injection valve 78 or bypass valve 85, the refrigerant which is introduced into third injection flow path 71 may be injected into compressor 10 at third injection inlet 13 via injection valve 78, and suctioned into compressor 10 in suction unit 10*a* via bypass valve 85.

Meanwhile, the main refrigerant passing through third internal heat exchanger 70 may be expanded while passing through second expansion device 35, and then may flow into inside heat exchanger 40. Also, the refrigerant evaporated in inside heat exchanger 40 may be suctioned into suction unit 10*a* of compressor 10 via a flow switching unit 15. The flow direction of the refrigerant described above is described based on the cooling operation, and is reversely operated in the heating operation.

Figure 2:
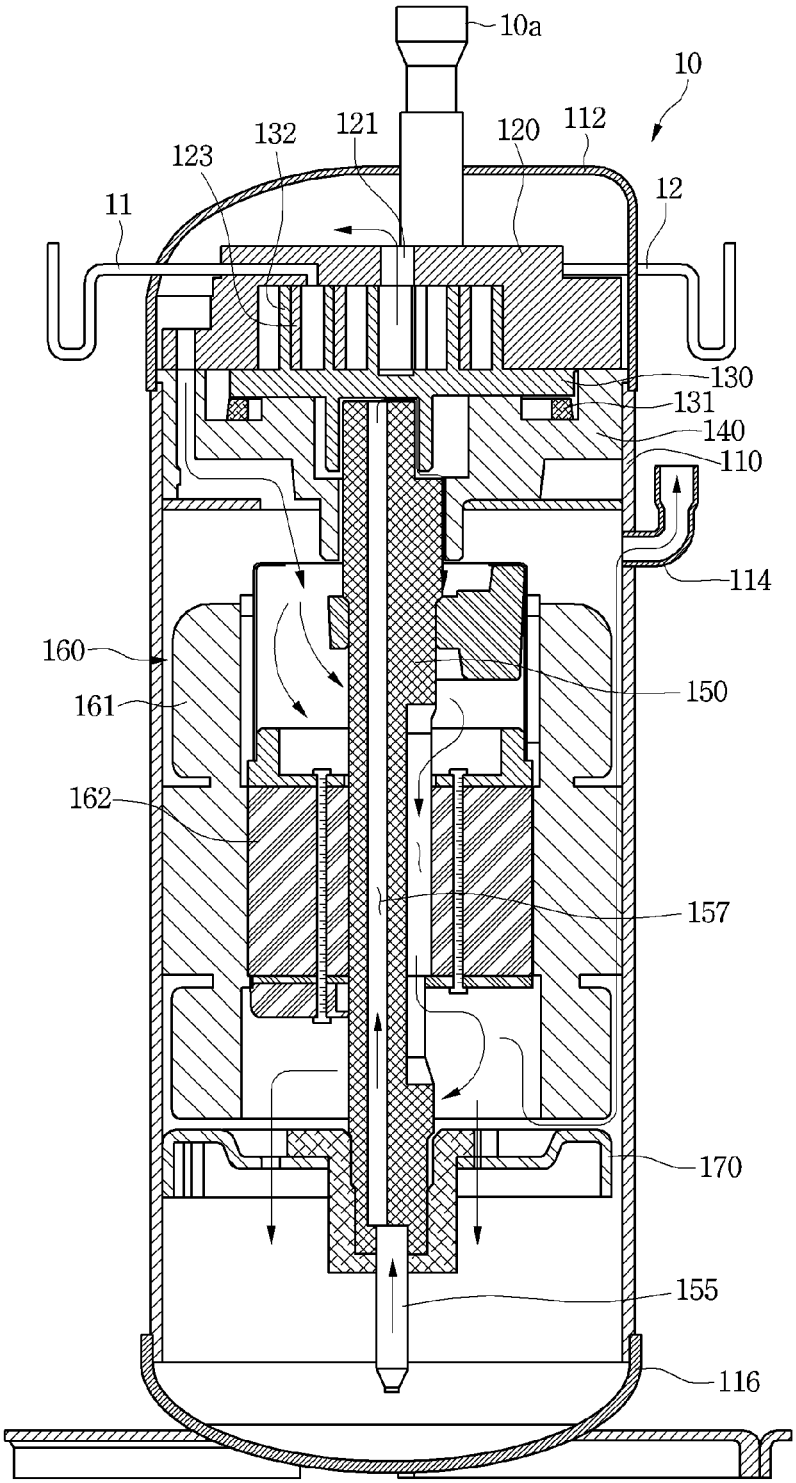
FIG. 2 is a cross-sectional view illustrating a configuration of a compressor according to the first embodiment.
Figure 3:
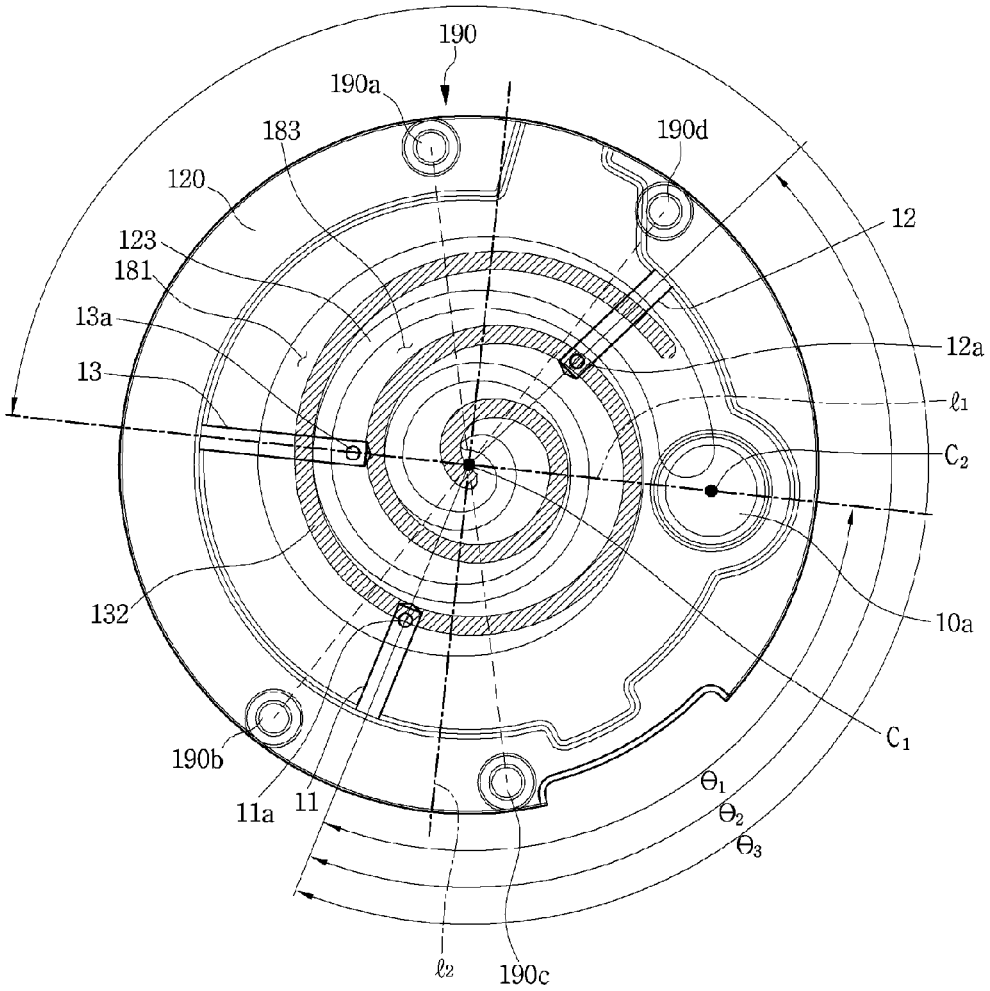
FIG. 3 is a view illustrating an arrangement of a scroll wrap and an injection inlet in a compressor according to the first embodiment.

FIG. 2 is a cross-sectional view illustrating a configuration of a compressor according to a first embodiment and FIG. 3 is a view illustrating an arrangement of a scroll wrap and an injection inlet in a compressor according to a first embodiment.

Referring to FIG. 2, a scroll compressor 10 includes a housing 110, a discharge cover 112 which shields an upper side of the housing, and a base cover 116 which is provided on a lower side of the housing 110 and stores oil. A suction unit 10*a* is coupled to the discharge cover 112. Suction unit 10*a* extends downward to pass through discharge cover 112 and is coupled to a fixed scroll 120.

Scroll compressor 10 includes a motor 160 which is included in housing 110 and generates a rotational force, a rotation shaft 150 which rotates while passing through a center of motor 160, a main frame 140 which supports an upper portion of rotation shaft 150, and a compression unit which is provided on an upper side of main frame 140 and compresses a refrigerant.

Motor 160 includes a stator 161 coupled to an inner circumferential surface of housing 110, and a rotor 162 which rotates inside stator 161. Rotation shaft 150 is disposed so as to pass through a center portion of rotor 162.

An oil supply flow path 157 is formed in the center portion of rotation shaft 150 so as to be eccentric to any one side, and thus oil which is introduced into oil supply flow path 157 is raised by the centrifugal force generated by the rotation of rotation shaft 150.

An oil supply unit 155 is coupled to a lower side of rotation shaft 150 and moves the oil stored in base cover 116 to oil supply flow path 157 while integrally rotating with rotation shaft 150.

The compression unit includes fixed scroll 120 which is installed on an upper surface of main frame 140 and connected to suction unit 10*a*, an orbiting scroll 130 engaged with fixed scroll 120 to form a compression chamber and to be pivotally supported on upper surface of the main frame 140, and an Oldham's ring 131 which is installed between orbiting scroll 130 and main frame 140, and orbits orbiting scroll 130 while preventing rotation of orbiting scroll 130. Orbiting scroll 130 is coupled to rotation shaft 150 to receive a rotation force from rotation shaft 150.

Fixed scroll 120 and orbiting scroll 130 are disposed to have a phase difference of 180 degrees from each other. A fixed scroll wrap 123 having a spiral shape is provided in fixed scroll 120, and an orbiting scroll wrap 132 having a spiral shape is provided in orbiting scroll 130. For convenience, fixed scroll 120 is referred to as "a first scroll," and orbiting scroll 130 is referred to as "a second scroll." Also, fixed scroll wrap 123 is referred to as "a first wrap," and orbiting scroll wrap 132 is referred to as "a second wrap."

The compression chamber may be formed in a plurality by the engagement of fixed scroll wrap 123 and orbiting scroll wrap 132. The refrigerant which is introduced into the plurality of compression chambers 181 and 183 by the orbiting motion of orbiting scroll 130 may be compressed to a high pressure. Also, a discharge hole 121 into which the refrigerant compressed to a high pressure and oil fluid are discharged is formed near a center portion of an upper portion of fixed scroll 120.

Specifically, in plurality of compression chambers 181 and 183, a volume thereof is reduced by the orbiting motion of orbiting scroll 130 while moving toward the center from the outside of fixed scroll 120 toward discharge hole 121, and the refrigerant is compressed in the reduced volume and then discharged to the outside of fixed scroll 120 through discharge hole 121.

Fluid discharged through discharge hole 121 is introduced into the inside of housing 110 and then is discharged through discharge pipe 114. Discharge pipe 114 may be coupled to a side of housing 110.

Meanwhile, a first injection inlet 11, a second injection inlet 12, and a third injection inlet 13 are coupled to compressor 10. The first to third injection inlets 11, 12, and 13 may be spaced apart from each other and each may be coupled to discharge cover 112.

Specifically, first injection inlet 11 passes through the discharge cover 112 on one side surface of discharge cover 112 to be inserted into fixed scroll 120. On another side surface of discharge cover 112, second injection inlet 12 passes through discharge cover 112 to be inserted into fixed scroll 120. Also, on still another side surface of discharge cover 112, third injection inlet 13 passes through discharge cover 112 to be inserted into fixed scroll 120.

The first to third injection inlets 11, 12, and 13 may be disposed to be spaced apart from each other by a set angle based on a compression direction of the refrigerant or a direction opposing the compression direction.

A plurality of injection holes 11*a*, 12*a*, and 13*a* are formed in the fixed scroll 120 to inject the refrigerant into a plurality of compression chambers.

The plurality of injection holes 11*a*, 12*a*, and 13*a* includes a first injection hole 11*a* coupled to first injection inlet 11, a second injection hole 12*a* coupled to second injection inlet 12, and a third injection hole 13*a* coupled to third injection inlet 13. For example, first injection inlet 11, second injection inlet 12, and third injection inlet 13 may be inserted into injection holes 11*a*, 12*a*, and 13*a*, respectively.

While orbiting scroll 130 rotates, orbiting scroll wrap 132 selectively opens and closes first injection hole 11*a*, second injection hole 12*a*, or third injection hole 13*a*.

Specifically, when orbiting scroll wrap 132 is located at the first position or rotation shaft 150 is at a first angle, the refrigerant suctioned through suction unit 10*a* is introduced into an open space formed by fixed scroll wrap 123 and orbiting scroll wrap 132.

Also, when the orbiting scroll 130 continuously orbits, the open space is shielded by orbiting scroll wrap 132 to complete a suction chamber. Here, the suction chamber is understood as a storage space in a state in which the suctioning of the refrigerant is completed, and when orbiting scroll wrap 132 orbits, the suction chamber is switched into the compression chamber.

When orbiting scroll 130 continuously orbits, the suction chamber may be compressed while moving from the outside region of fixed scroll 120 to the inside region thereof. In this case, the compression chamber may move in a counterclockwise direction.

The compression chamber moves to approach discharge hole 121, and the refrigerant is discharged through discharge hole 121 when the compression chamber reaches discharge hole 121. Like this, the formation of the compression chamber and the compression of the refrigerant are repeatedly performed by the orbiting motion of orbiting scroll 130.

Meanwhile, in the compression of the refrigerant, the refrigerant of the first to third injection flow paths 51, 61, and 71 is selectively injected into the plurality of compression chambers through first injection inlet 11, the second injection inlet 12, or third injection inlet 13.

In the orbiting motion of orbiting scroll 130, orbiting scroll wrap 132 moves to selectively open or close first injection hole 11*a*, second injection hole 12*a*, or third injection hole 13*a*. In a state in which the compression chamber moves to one side of first injection hole 11*a*, second injection hole 12*a*, or third injection hole 13*a*, when first injection hole 11*a*, second injection hole 12*a*, or third injection hole 13*a* opens, the refrigerant may be injected into the corresponding compression chamber.

For example, the refrigerant injected through first injection inlet 11 may be formed to have a first intermediate pressure, and may be injected into the compression chamber before the refrigerant is compressed more in the compression chamber. On the other hand, the refrigerant injected through second injection inlet 12 may be formed to have a second intermediate pressure (greater than the first intermediate pressure), and may be injected into the compression chamber in a state in which the refrigerant is compressed relatively more in the compression chamber.

Also, the refrigerant injected through third injection inlet 13 may be formed to have a third intermediate pressure (greater than the second intermediate pressure), and may be injected into the compression chamber in which the refrigerant is compressed more compared to the compression chamber in which the refrigerant is injected through first and second injection inlets 11 and 12.

Therefore, first injection hole 11*a* is formed at a position relatively far away from discharge hole 121 in a radial direction. On the other hand, second injection hole 12*a* may be formed at a closer position, than first injection hole 11*a*, from discharge hole 121 in a radial direction, and third injection hole 13*a* may be formed at a closer position, than second injection hole 12*a*, from discharge hole 121 in a radial direction.

According to the positions of the first, second, and third injection inlets 11, 12, and 13, that is, the positions of the first, second, and third injection holes 11*a*, 12*a*, and 13*a*, degrees of opening of the first, second, and third injection holes 11*a*, 12*a*, and 13*a* when the refrigerant is injected into the compression chamber are changed.

For example, the position of the compression chamber is continuously changed according to the orbiting of the orbiting scroll wrap 132, and the first, second, and third injection holes 11*a*, 12*a*, and 13*a* may be in a completely closed state, in an opened state of about 50%, or in a completely opened state according to the positions in which the first, second, and third injection holes 11*a*, 12*a*, and 13*a* are formed based on a predetermined position of the compression chamber.

Meanwhile, the positions of the first, second, and third injection inlets 11, 12, and 13 may be understood as the concept of whether the injection inlet may be opened when orbiting scroll 130 rotates at a certain degree based on a time point in which the suctioning of the refrigerant is completed through refrigerant suction unit 10*a*. Here, a degree in which the orbiting scroll 130 rotates may correspond to a degree in which the rotation shaft 150 rotates.

In other words, the embodiment of the present disclosure specifies the positions of the first, second, and third injection inlets 11, 12, and 13 or the positions of the first, second, and third injection holes 11*a*, 12*a*, and 13*a* with respect to whether the injection is achieved or not through first injection inlet 11, second injection inlet 12, or third injection inlet 13 when the refrigerant is compressed at a certain degree, based on a time point in which the refrigerant is suctioned through refrigerant suction unit 10*a*.

Referring to FIG. 3, a plurality of compression chambers are formed by the engagement of orbiting scroll 130 and fixed scroll 120 according to the embodiment of the present disclosure. Also, volumes of the plurality of compression chambers are reduced by the orbiting motion of orbiting scroll 130 while moving from the outside portion of fixed scroll 120 toward the center.

For example, the plurality of compression chambers include a first compression chamber 181 and a second compression chamber 183. According to the orbiting of orbiting scroll wrap 132, first compression chamber 181 and second compression chamber 183 rotate in a counterclockwise direction to have a phase difference of about 180°. The refrigerant in second compression chamber 183 is formed to have a higher pressure than the refrigerant in the first compression chamber 181.

Also, while first and second compression chambers 181 and 183 rotate, when orbiting scroll wrap 132 opens first injection hole 11*a*, second injection hole 12*a*, or third injection hole 13*a*, the refrigerant may be injected into first compression chamber 181 or second compression chamber 183.

Specifically, while first compression chamber 181 rotates in a counterclockwise direction, when first compression chamber 181 is located on one side of first injection inlet 11 and first injection hole 11*a* opens, the refrigerant may be injected into first compression chamber 181 through first injection hole 11*a*.

In this case, the opening and closing of first injection hole 11*a* refers to gradually opening and closing first injection hole 11*a* according to the orbiting of orbiting scroll wrap 132 rather than a concept of on and off. After the refrigerant is injected into first compression chamber 181, the compression is continued while first compression chamber 181 moves in a counterclockwise direction.

Meanwhile, while second compression chamber 183 rotates in a counterclockwise direction, when second compression chamber 183 is located at one side of second injection inlet 12 and second injection hole 12*a* opens, the refrigerant may be injected into second compression chamber 183 through second injection hole 12*a*.

Likewise, the opening and closing of second injection hole 12*a* refers to gradually opening and closing second injection hole 12*a* according to the orbiting of orbiting scroll wrap 132 rather than a concept of on and off. After second compression chamber 183 is injected into the refrigerant, the compression is continued while second compression chamber 183 moves in a counterclockwise direction.

While second compression chamber 183 rotates in a counterclockwise, when second compression chamber 183 is located at third injection inlet 13 and third injection hole 13*a* opens, the refrigerant may be injected into second compression chamber 183 through third injection hole 13*a*.

As described above, the opening and closing of third injection hole 13*a* refers to gradually opening and closing third injection hole 13*a* according to the orbiting of orbiting scroll wrap 132 rather than a concept of on and off. After the refrigerant is injected through third injection hole 13*a*, the compression is continued while second compression chamber 183 moves in a counterclockwise direction, and then the refrigerant may be discharged through discharge hole 121 after the compression is completed.

The position of first injection inlet 11 or first injection hole 11*a* may be formed a the position at which first injection hole 11*a* is opened before the suctioning of the refrigerant through the suction unit 10*a* is completed, that is, before the inhalation chamber is completed or closed.

Specifically, a center portion or a center of mass portion C1 and a center portion C2 corresponding to a center of suction unit 10*a* are formed in fixed scroll 120. The center of mass portion C1 may be understood as a position which represents a center of gravity of fixed scroll 120 or main frame 140. For example, the center of mass portion C1 may correspond to a center portion of discharge hole 121. For convenience of description, the center of mass portion C1 may be referred to as "a first center portion," and center portion C2 may refer to "a second center portion."

Figure 6:
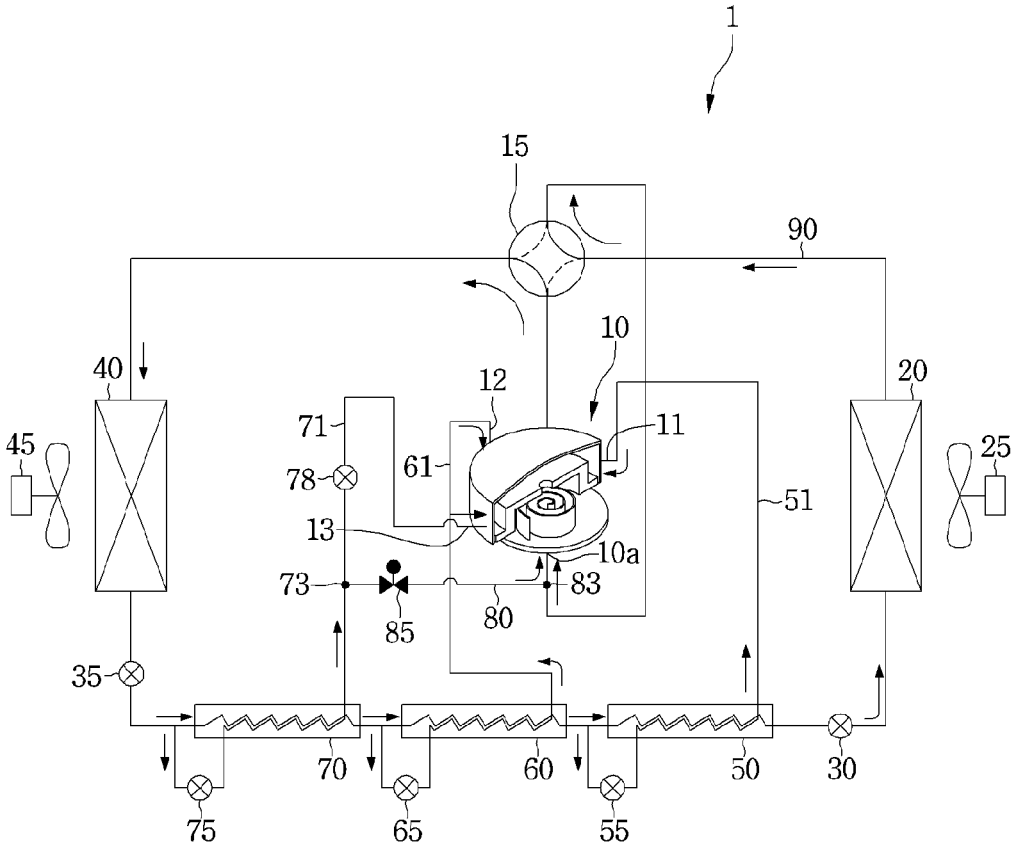
FIG. 6 is a system diagram illustrating a flow state of a refrigerant during the heating operation of an air conditioner according to the first embodiment.

Fixed scroll 120 includes a plurality of fastening units 190 coupled to main frame 140. A number of the fastening unit 190 may be an even number. For example, as illustrated in FIG. 6, the plurality of fastening units 190 is configured as four, include a first fastening unit 190*a*, a second fastening unit 190*b*, a third fastening unit 190*c*, and a fourth fastening unit 190*d*, which are spaced apart from each other. However, the number of the fastening units 190 is not limited thereto, and fastening units 190 may be formed as six, eight, or twelve.

First fastening unit 190*a* and second fastening unit 190*b* may be located at one side based on a second extension line l2, and third fastening unit 190*c* and fourth fastening unit 190*d* may be located at the other side based on second extension line l2.

Fixed scroll 120 may be coupled to main frame 140 through the plurality of fastening units 190, and thus may be supported on an upper side of main frame 140 in a balanced state.

Also, center of mass portion C1 of fixed scroll 120 may be formed at a point in which a first line which connects two facing fastening units and a second line which connects the other two facing fastening units intersect. That is, center of mass portion C1 may be formed at a point in which the first line which connects first fastening unit 190*a* to third fastening unit 190*c* and second line which connects second fastening unit 190*b* to fourth fastening unit 190*d* intersect.

A virtual line which extends from first center portion C1 toward second center portion C2 is referred to as a first extension line l1, and a virtual line which extends from first center portion C1 toward a direction perpendicular to first extension line l1 is referred to as a second extension line l2.

First injection inlet 11 or first injection hole 11*a* may be formed at a position in which first extension line l1 is rotated by a first set angle θ1 in a clockwise direction based on first center portion C1. Here, the clockwise direction is understood as a direction opposite the rotation direction of the compression chamber. That is, the rotation direction of the compression chamber corresponds to a counterclockwise direction.

For example, first set angle θ1 is formed in a range of 61° to 101°. Also, when first injection inlet 11 or first injection hole 11*a* is located at first set angle θ1, the opening of the first injection hole 11*a* may be started before a time point in which the suctioning of the refrigerant is completed. That is, a time point in which the inhalation chamber is completed.

Specifically, when a time point in which the suctioning of the refrigerant is completed through the suction unit 10*a*, which is referred to as a time point in which the rotation angle of the rotation shaft 150 is 0°, the opening of first injection hole 11*a* may be started when the rotation angle of the rotation shaft 150 is in a range of −50° to −10°. That is, a range of the first set angle θ1 may correspond to a range of −50° to −10° based on the rotation angle of the rotation shaft 150.

Here, when the rotation angle of rotation shaft 150 is 0°, the suctioning of the refrigerant is completed, a degree of opening of first injection hole 11*a* is gradually increased and the injection is further performed while the rotation angle thereof is increased to 10° or 20°, and in addition, the compression of the refrigerant is continued. In this case, the compression of the refrigerant is understood as "a primary compression."

That is, even when first injection hole 11*a* is opened to start the injection of the refrigerant before the suctioning of the refrigerant is completed through suction unit 10*a*, a time point in which first injection hole 11*a* is completely opened and an amount of the injection of the refrigerant is increased may be a time point in which the compression of the refrigerant is made after the injection thereof is completed through suction unit 10*a*.

Accordingly, the compression of the refrigerant is achieved in the compression chamber even when the injection hole is gradually opened after a predetermined time and the injection is done. Therefore, according to the disclosure, when the injection hole is opened too late, the pressure of the compression chamber is already increased to a predetermined pressure or more, that is, internal resistance of the compression chamber is increased, and thus a problem in that an amount of flow suitable for injecting may be reduced by the pressure difference may be prevented.

Meanwhile, second injection inlet 12 or second injection hole 12*a* may be formed at a position rotated from a position of first injection inlet 11 or first injection hole 11*a* by a second set angle θ2 in a counterclockwise direction. For example, the second set angle θ2 may be formed in a range of 130° to 150°.

Substantially, when first injection inlet 11 and second injection inlet 12 have a phase difference of 180° or more, one compression chamber in which the refrigerant is injected through first injection inlet 11 and the other compression chamber in which the refrigerant is injected through second injection inlet 12 may be separated from each other.

That is, when the phase different is 180° or more, first injection hole 11*a* may be shielded by orbiting scroll wrap 132 at a time point in which second injection hole 12*a* opens. Therefore, the refrigerant having different intermediate pressures from each other (e.g., injection hole overlapping phenomenon) may be prevented from being simultaneously injected in the same compression chamber.

Figure 5:
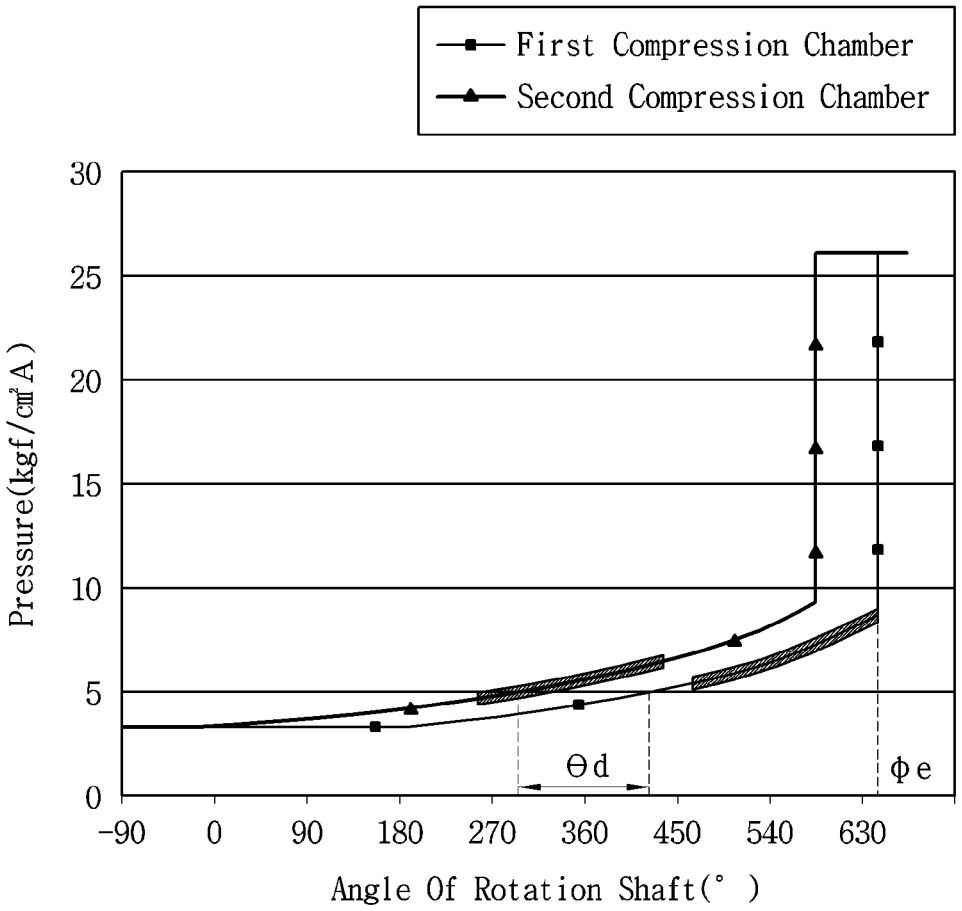
FIG. 5 is a graph illustrating the state in which internal pressures of first and second compression chambers according to the first embodiment are changed according to an angle of a rotation shaft.

However, as provided in the embodiment, in a case in which three injections of the refrigerant are performed before the refrigerant is discharged after the suctioning of the refrigerant, when first injection inlet 11 and second injection inlet 12 have a phase difference of 180° or more, a position of third injection inlet 13 is very close to discharge hole 121, and thus a problem in that the refrigerant of the compression chamber backflows to third injection flow path 71 may occur (see FIG. 5).

Therefore, in the embodiment, even when the injection hole overlapping phenomenon occurs, a degraded capability of the compressor is minimized by reducing a degree of overlapping. To this end, at the time of the injection hole overlapping, a rotation angle of the rotation shaft 150 during the injection hole overlapping is limited to a maximum 50° (see FIG. 4).

When the rotation angle of rotation shaft 150 is 50°, second set angle θ2 becomes 130°. On the other hand, when the rotation angle of rotation shaft 150 is 30°, second set angle θ2 becomes 150°.

Accordingly, when second injection hole 12*a* starts to open, first injection hole 11*a* is in an opened state, and when rotation shaft 150 rotates by a range of 30° to 50° after second injection hole 12*a* is opened, first injection hole 11*a* may be closed. That is, the overlapping phenomenon of first injection hole 11*a* and second injection hole 12*a* may occur.

Meanwhile, during the injection of the refrigerant through second injection hole 12*a*, the compression of the compression chamber is continued. In this case, the compression of the refrigerant is understood as "a secondary compression."

Third injection inlet 13 or third injection hole 13*a* may be formed at a position rotated from a position of first injection inlet 11 or first injection hole 11*a* by a third set angle θ3 in a counterclockwise direction. For example, third set angle θ3 is formed in a range of 260° to 300°. The range of third set angle θ3 may be understood as a value determined in consideration of the above-described injection hole overlapping phenomenon.

That is, when third injection hole 13*a* starts to open, second injection hole 12*a* is in an opened state. When the rotation shaft 150 further rotates by a range of 30° to 50° after third injection hole 13*a* is opened, second injection hole 12*a* may be closed. That is, the overlapping phenomenon of second injection hole 12*a* and third injection hole 13*a* may occur.

Meanwhile, during the injection of the refrigerant through third injection hole 13*a*, the compression of the compression chamber is continued. In this case, the compression of the refrigerant is understood as "a tertiary compression."

After the injection of the refrigerant through third injection hole 13*a* is completed, that is after third injection hole 13*a* is closed, the compression chamber may be further compressed while rotating in a counterclockwise direction. In this case, the compression of the refrigerant is understood as "a quaternary compression." The refrigerant in which the quaternary compression is completed may be discharged to the outside of the scroll 120 through discharge hole 121.

Figure 4:
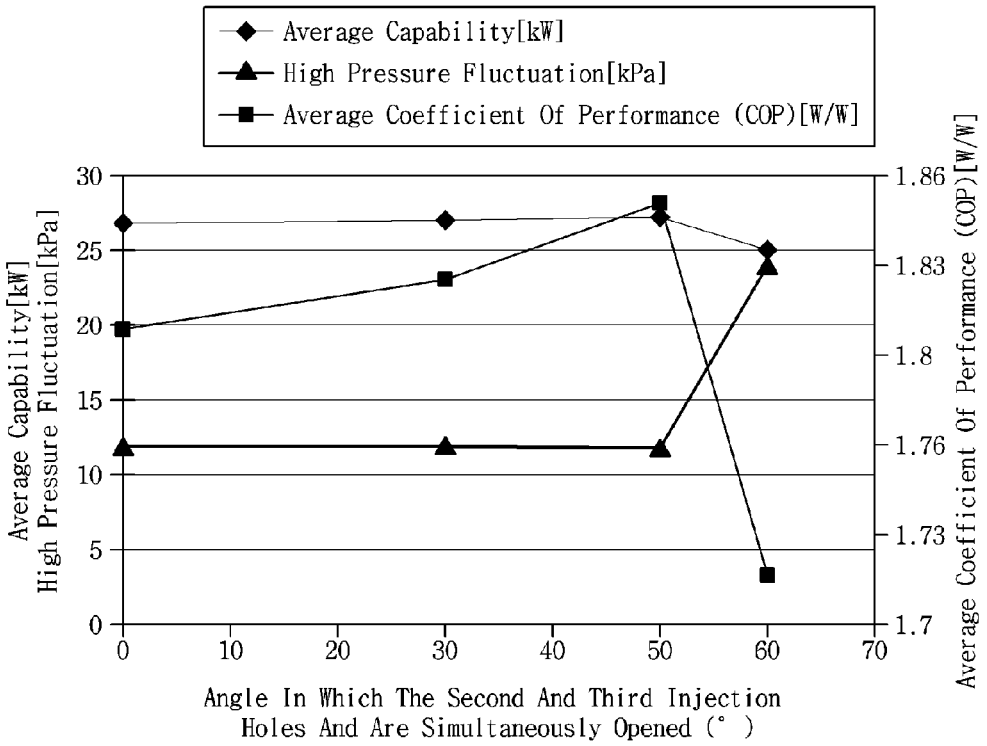
FIG. 4 is a graph illustrating the performance changed according to an angle of a rotation shaft which rotates while second and third injection inlets according to the first embodiment are simultaneously opened.

FIG. 4 is a graph illustrating the performance changed according to an angle of a rotation shaft which rotates while second and third injection inlets according to a first embodiment are simultaneously opened.

Referring to FIG. 4, with respect to the above-described injection hole overlapping phenomenon, while second and third injection holes 12*a* and 13*a* are simultaneously opened, a rotation angle of rotation shaft 150 is represented on a horizontal axis. In FIG. 4, although it is described based on the overlapping phenomenon of second and third injection holes 12*a* and 13*a*, it may be applied to the overlapping phenomenon of first and second injection holes 11*a* and 12*a*.

Also, according to an angle change of the horizontal axis, factors related to the performance of compressor 10 or air conditioner 1 are represented on a vertical axis. Specifically, the factors represented on the vertical axis may include the average capability (KW) of air conditioner 1, an average coefficient of performance (COP), and a pressure of the refrigerant discharged from the compressor 10, that is, high pressure fluctuation (Kpa).

In the injection of the refrigerant having different intermediate pressures from each other, a change of the pressure occurs according to the mixture of the existing refrigerant in the compression chamber and the injected refrigerant. The high pressure fluctuation (Kpa) refers to discharged high pressure fluctuation changed by the change of the pressure. The fluctuation may be understood as a difference of a maximum value and a minimum value of the discharged high pressure.

Until the rotation angle of rotation shaft 150, that is, angles in which second and third injection holes 12*a* and 13*a* are simultaneously opened, is 50°, the average capability of the air conditioner 1 and the high pressure fluctuation may not significantly change, and the average coefficient of performance (COP) may slightly increase.

However, when the rotation angle of rotation shaft 150 is greater than 50°, for example, when the rotation angle is 60°, the average coefficient of performance of air conditioner 1 is significantly reduced, and the average capability is also reduced. Also, the high pressure fluctuation is significantly increased. When the high pressure fluctuation is increased, the operation stability and reliability of the compressor may be reduced, and the performance of the air conditioner may be reduced. Therefore, it is preferred to maintain the rotation angle of rotation shaft 150 at 50° or less.

Meanwhile, the rotation angle of rotation shaft 150 may be maintained at 30° or more. Specifically, when the rotation angle of rotation shaft 150 is maintained at 30° or less, as described above, the phase difference between two injection inlets is close to 180°, a position of third injection inlet 13 is very close to a discharged pressure of the refrigerant, and thus a problem in that the injection of the refrigerant through third injection inlet 13 is limited may occur.

Therefore, the position of third injection inlet 13 is preferably maintained at 250° or less based on a time point of suctioning completion (see FIG. 5). In view thereof, the rotation angle of the rotation shaft 150 may be formed in a range of 30° to 50°, and accordingly second set angle θ2 may be formed in a range of 130° to 150° and third set angle θ3 may be formed in a range of 260° to 300°.

FIG. 5 is a graph illustrating the state in which internal pressures of first and second compression chambers according to a first embodiment are changed according to an angle of a rotation shaft.

Referring to FIG. 5, the graph in which a pressure in first and second compression chambers 181 and 183 is changed according to a rotational angle of rotation shaft 150 according to a first embodiment is illustrated.

When the rotation angle of rotation shaft 150 is 0°, the suctioning of the refrigerant is completed and thus a time point in which an inhalation chamber is completed is specified. Internal pressures of first and second compression chambers 181 and 183 may be gradually increased while first and second compression chambers 181 and 183 move as the rotation angle is increased. First compression chamber 181 and second compression chamber 183 are compressed while moving and having a phase difference θd. For example, the phase difference θd is about 180°.

Also, when the rotation angle is increased by a set angle, for example, when the rotation angle is represented by θe (about 630°), the internal pressure of the compression chamber is sharply increased. Here, rotation shaft 150 may be rotated about three rotations (1080°) until the refrigerant is discharged through discharge hole 121 after the refrigerant is suctioned through suction unit 10*a*.

When third injection inlet 13 is located at a position in which the internal pressure of the compression chamber is significantly increased, the internal pressure (internal resistance) of the compression chamber is greater than the pressure of the injected refrigerant or a difference therebetween is not great, problems in that the injection of the refrigerant through third injection hole 13*a* is limited and that a backflow of the refrigerant from the compression chamber to third injection inlet 13 may occur.

Therefore, third injection inlet 13 may be formed at a position of 250° or less in a direction of compression of the refrigerant as a starting point, a position in which before the internal pressure of the compression chamber is significantly increased, for example, a position in which the suctioning of the refrigerant is completed.

Specifically, referring to FIG. 5, areas represented by thick lines in a graph of the pressure changes of the first and second compression chambers indicate periods in which third injection hole 13*a* is open to first compression chamber 181 or second compression chamber 183 when third injection inlet 13 is located at an angle of 250°.

Here, an end portion of the period in which third injection hole 13*a* is open to first compression chamber 181 corresponds to the rotation angle θe of the rotation shaft in which the pressure of first compression chamber 181 is sharply increased. Therefore, when third injection inlet 13 is positioned at an angle of 250° or more, a problem in that the refrigerant is injected even after a time point in which the internal pressure of the first compression chamber 181 is significantly increased may occur. Therefore, according to the embodiment, third injection inlet 13 is formed and positioned at an angle of 250° or less.

When third injection inlet 13 is positioned at an angle of 250°, the third set angle θ3 may correspond to 300°. Also, a position of third injection inlet 13 when third set angle θ3 is 260° may correspond to a position according to a condition in which the rotation angle of rotation shaft 150 is maintained at 50° or less, in consideration of the injection hole overlapping phenomenon.

Accordingly, because the injection of the refrigerant is performed through three injection inlets, an amount of injection flow may be increased, and positions of the three injection inlets are optimized, the performance of the compressor and the air conditioner may improve.

FIG. 6 is a system diagram illustrating a flow state of a refrigerant during the heating operation of an air conditioner according to a first embodiment.

Referring to FIG. 6, when air conditioner 1 performs a heating operation, the refrigerant suctioned in compressor 10 through suction unit 10*a* is compressed to be mixed with the refrigerant injected to compressor 10 through first injection flow path 51. The process until the refrigerant is mixed with the injected refrigerant after the refrigerant is suctioned in compressor 10 is referred to as "a primary compression."

The refrigerant compressed by the primary compression is compressed again, the compressed refrigerant is mixed with the refrigerant injected into the compressor 10 through second injection flow path 61. This process is referred to as "a secondary compression."

The refrigerant compressed by the secondary compression is compressed again, the compressed refrigerant is mixed with the refrigerant injected into compressor 10 through third injection flow path 71. This process is referred to as "a tertiary compression."

The refrigerant compressed by the tertiary compression is compressed again, and a compression process in this case is referred to as "a quaternary compression." Like this, in the case of the heating operation, three injection processes and four compression processes are performed. In compressor 10, the refrigerant compressed by the tertiary compression may flow into inside heat exchanger 40 through flow path switching unit 15, and the refrigerant condensed in inside heat exchanger 40 passes through the third internal heat exchanger 70.

In this case, some refrigerant (the third branched refrigerant) is bypassed to be expanded in third injection expansion unit 75. The refrigerant expanded in third injection expansion unit 75 is heat-exchanged with the main refrigerant. In this process, the main refrigerant is supercooled, and the third branched refrigerant may be injected into the compressor 10 through third injection inlet 13.

In this case, injection valve 78 is opened and bypass valve 85 is closed, the refrigerant which in introduced into third injection flow path 71 passes through injection valve 78, and thus may be injected into compressor 10.

Meanwhile, the main refrigerant passed through third internal heat exchanger 70 passes through second internal heat exchanger 60, some refrigerant (the second branched refrigerant) is bypassed to be expanded in second injection expansion unit 65. The refrigerant expanded in second injection expansion unit 65 is heat-exchanged with the main refrigerant. In this process, the main refrigerant is supercooled, and the second branched refrigerant may be injected into compressor 10 through second injection inlet 12.

The main refrigerant passed through second internal heat exchanger 60 passes through first internal heat exchanger 50, some refrigerant (the first branched refrigerant) is bypassed to be expanded in first injection expansion unit 55. The refrigerant expanded in first injection expansion unit 55 is heat-exchanged with the main refrigerant. In this process, the main refrigerant is supercooled, and the first branched refrigerant may be injected into compressor 10 through first injection inlet 11.

The main refrigerant passed through first internal heat exchanger 50 is expanded in first expansion device 30 and then evaporated in the outside heat exchanger 20, and may be suctioned in suction unit 10*a* of compressor 10 via flow switching unit 15.

Thus, when the air conditioner 1 performs the heating operation, three injections of the refrigerant are performed passing through the plurality of internal heat exchangers 50, 60, and 70, and it is possible to increase an amount of circulating refrigerant of the refrigerant system. Accordingly, the heating capability of the system may be improved.

Meanwhile, as described above, during the heating operation of the air conditioner, in order to perform the injection of the refrigerant, it may be controlled so that the first, second, and third injection expansion units 55, 65, and 75 are opened and the injection valve 78 is opened. However, when it is not required for the injection of the refrigerant, for example, when an outside air temperature is greater than a set temperature or the load of the inside unit is not large, the heating operation of the air conditioner may be controlled so that the first, second, and third injection expansion units 55, 65, and 75 are closed and the injection valve 78 is closed, and thus the injection may not be performed.

Figure 7:
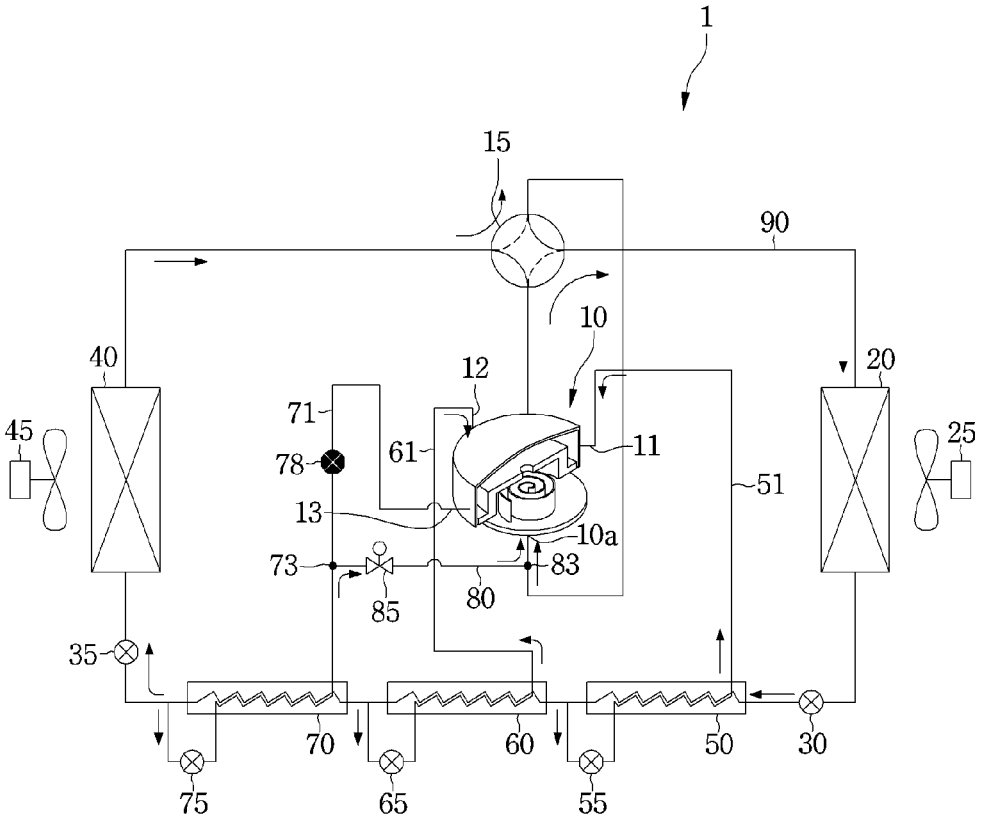
FIG. 7 is a diagram illustrating a flow state of a refrigerant during the cooling operation of an air conditioner according to the first embodiment.

FIG. 7 is a diagram illustrating a flow state of a refrigerant during the cooling operation of an air conditioner according to a first embodiment.

Referring to FIG. 7, air conditioner 1 performs a cooling operation, and the refrigerant suctioned in compressor 10 through suction unit 10*a* is compressed to be mixed with the refrigerant injected into compressor 10 through first injection flow path 51. This process is referred to as "a primary compression."

The refrigerant compressed by the primary compression is compressed again, and the compressed refrigerant is mixed with the refrigerant injected into compressor 10 through second injection flow path 61. This process is referred to as "a secondary compression."

The refrigerant compressed by the secondary compression is compressed again, and a compression process in this case is referred to as "a tertiary compression." The refrigerant compressed by the secondary compression is discharged from compressor 10, and introduced into outside heat exchanger 20 via flow switching unit 15.

Meanwhile, the injection of the refrigerant through the third injection inlet 13 may not be performed.

The refrigerant condensed in outside heat exchanger 20 passes through first internal heat exchanger 50, some refrigerant (the first branched refrigerant) is bypassed to be expanded in first injection expansion unit 55. The refrigerant expanded in first injection expansion unit 55 is heat-exchanged with the main refrigerant, in this process, the main refrigerant is supercooled, and the first branched refrigerant may be injected into compressor 10 first injection inlet 11.

The main refrigerant passed through first internal heat exchanger 50 passes through second internal heat exchanger 60, and some refrigerant (the second branched refrigerant) is bypassed to be expanded in second injection expansion unit 65. The refrigerant expanded in second injection expansion unit 65 is heat-exchanged with the main refrigerant, In this process, the main refrigerant is super cooled and the second branched refrigerant may be injected into compressor 10 through second injection inlet 12.

The main refrigerant passed through second internal heat exchanger 60 passes through third internal heat exchanger 70, and the third branched refrigerant is bypassed to be expanded in third injection expansion unit 75. The refrigerant expanded in third injection expansion unit 75 is heat-exchanged with the main refrigerant. In this process, the main refrigerant is super cooled and the third branched refrigerant is suctioned in suction unit 10*a* of compressor 10 through bypass flow path 80.

According to this embodiment, injection valve 78 is closed and bypass valve 85 is opened, and the refrigerant that is introduced into third injection flow path 71 passes through the bypass valve 85 and may be suctioned in compressor 10.

In other words, during the cooling operation, the injection process on a high pressure side is limited and the refrigerant is suctioned in compressor 10, and thus a degree of supercooling may be further ensured. Thus, because the pressure of the refrigerant is reduced to the suctioning pressure (e.g., low pressure) of compressor 10 in third injection expansion unit 75, and decompressed refrigerant is heat-exchanged with the main refrigerant in third internal heat exchanger 70, a supercooling effect may be further improved.

Meanwhile, the main refrigerant passed through third internal heat exchanger 70 is expanded in second expansion device 35 and then evaporated in the inside heat exchanger 40, and may be suctioned in compressor 10 via flow switching unit 15. Accordingly, the refrigerant passed through inside heat exchanger 40 may be combined with the refrigerant passed through bypass flow path 80 in combining unit 83 and then may be suctioned in compressor 10.

When the air conditioner 1 performs the cooling operation, an evaporation pressure is increased by the relatively high outside air temperature. The difference between the low pressure and the high pressure during the cooling operation is less than compared to during the heating operation, and thus an effect in which a plurality of injections (e.g., three times) is performed on compressor 10 may be limited in consideration of a point in which the amount of injection flow is determined corresponding to the difference between the low pressure and the high pressure.

Therefore, the injection of the refrigerant on a high pressure side is omitted and direct suctioning is performed in compressor 10, and thus there is an advantage in which a degree of supercooling may be further ensured.

A bypass flow path which extends from first injection flow path 51 or second injection flow path 61 toward suction unit 10*a* of compressor 10 may be further provided. In this configuration, while it may be desired that only a one-time injection is performed in compressor 10 and two flow paths directly suctioned in suction unit 10*a* of compressor 10 are formed, such configuration of piping is difficult and an additional valve is required, which increases the costs.

Noise generated from the inside unit may be decreased when the degree of supercooling is increased during the cooling operation, the heat exchange efficiency of the system is increased, and the state of the refrigerant is introduced into the inside heat exchanger in a liquid state or a state in which a degree of dryness is low.

Hereinafter, a second embodiment of the present disclosure will be described. Some of the features of the second embodiment are different than those in the first embodiment. The features that are different are described herein. The features of the second embodiment that are the same as those in the first embodiment are referred to by the descriptions and reference numerals of the first embodiment.

Figure 8:
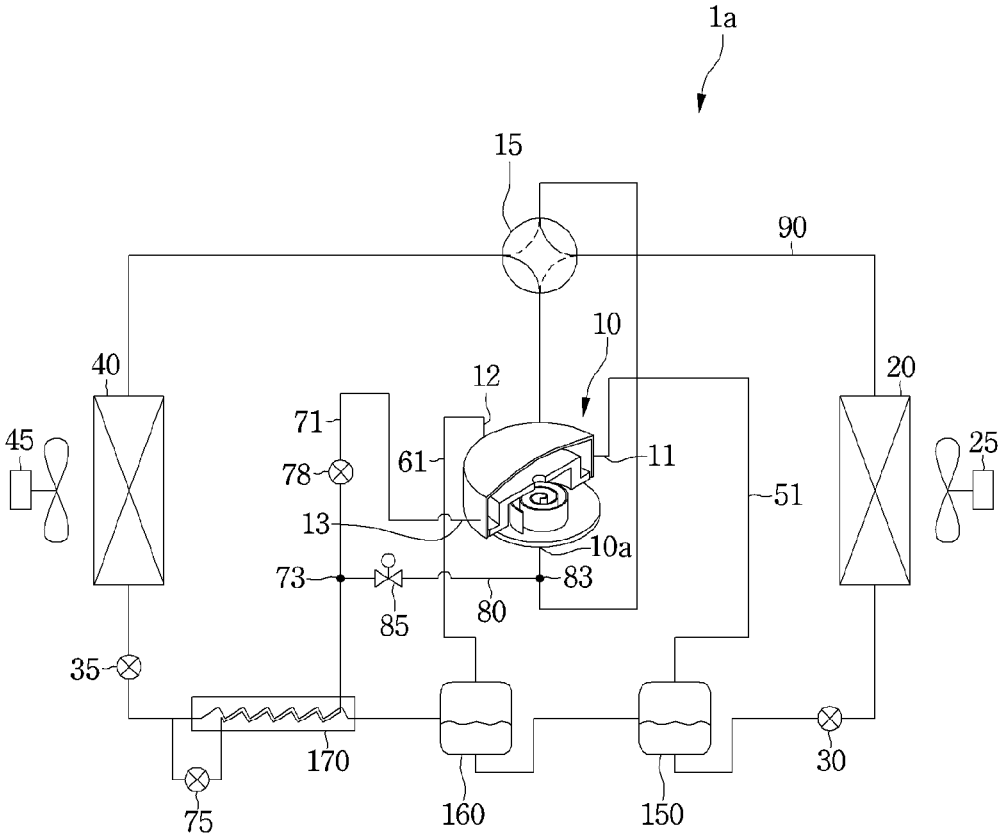
FIG. 8 is a system diagram illustrating a configuration of an air conditioner according to a second embodiment.

FIG. 8 is a system diagram illustrating a configuration of an air conditioner according to a second embodiment.

Referring to FIG. 8, an air conditioner 1*a* according to the second embodiment includes a first phase separator 150 connected to first injection flow path 51, a second phase separator 160 connected to second injection flow path 61, and an internal heat exchanger 170 connected to third injection flow path 71.

The description of internal heat exchanger 170 references the description of third internal heat exchanger 70 of the first embodiment.

First phase separator 150 and second phase separator 160 are understood as devices which separate the flowing refrigerant into the liquid refrigerant and the gaseous refrigerant. The gaseous refrigerant separated from first phase separator 150 may flow into first injection flow path 51 and the gaseous refrigerant separated from second phase separator 160 may flow into second injection flow path 61.

The phase separator 150 and the internal heat exchanger, which are devices which separate the refrigerant circulated in the air conditioner, are referred to as "refrigerant separation devices."

According to the embodiments of the present disclosure, an amount of refrigerant injected into a compressor is adjusted according to an operation mode of the air conditioner, which results in an efficient injection and a sufficient degree of super cooling.

Specifically, during a heating operation, the amount of refrigerant circulation can be increased by performing the refrigerant injection three times on the compressor.

During a cooling operation, there is an advantage in that the refrigerant injection can be performed twice on the compressor, which provides super cooling. Specifically, a bypass flow path which may bypass an injection flow path is provided, and the refrigerant passed through the inside heat exchanger bypasses through an inhalation unit of the compressor during the cooling operation, which provides super cooling.

Further, since the refrigerant formed to have an intermediate pressure is injected into the compressor, electric power required when the refrigerant is compressed in the compressor can be reduced and thus there is an advantage in which the cooling and heating efficiency can be increased.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An air conditioner comprising:

a scroll compressor to compress a refrigerant, the scroll compressor having a fixed scroll, an orbiting scroll, a suction unit, a plurality of injection inlets, and a discharge cover;

an inside heat exchanger into which the compressed refrigerant is introduced during a heating operation;

an outside heat exchanger into which the compressed refrigerant is introduced during a cooling operation;

a plurality of refrigerant separation devices through which a refrigerant condensed in the inside heat exchanger or the outside heat exchanger pass, the plurality of refrigerant separation devices including first, second, and third refrigerant separation devices;

a plurality of injection flow paths to extend from the plurality of refrigerant separation devices to the plurality of injection inlets, the plurality of injection flow paths including a first injection flow path coupled to the first refrigerant separation device, a second injection flow path coupled to the second refrigerant separation device, and a third injection flow path coupled to the third refrigerant separation device; and a bypass flow path to extend from one of the plurality of injection flow paths to the suction unit, wherein the plurality of injection inlets include:

a first inlet that passes through the discharge cover and is coupled to a first position of the fixed scroll to inject the refrigerant into a compression chamber, the first inlet being coupled to the first injection flow path;

a second inlet that passes through the discharge cover and is coupled to a second position of the fixed scroll to inject the refrigerant into the compression chamber, the second inlet being coupled to the second injection flow path; and a third inlet that passes through the discharge cover and is coupled to a third position of the fixed scroll to inject the refrigerant into the compression chamber, the third inlet being coupled to the third injection flow path, wherein the first, second and third position are formed at a different position with one another.

2. The air conditioner of claim 1, wherein the plurality of refrigerant separation devices include a first internal heat exchanger, a second internal heat exchanger, and a third internal heat exchanger.

3. The air conditioner of claim 2, wherein the plurality of injection flow paths include:

a first injection flow path coupled to the first internal heat exchanger to inject a refrigerant having a first intermediate pressure into the scroll compressor;

a second injection flow path coupled to the second internal heat exchanger to inject a refrigerant having a second intermediate pressure into the scroll compressor; and a third injection flow path coupled to the third internal heat exchanger to inject a refrigerant having a third intermediate pressure into the scroll compressor.

4. The air conditioner of claim 3, wherein the second intermediate pressure is higher than the first intermediate pressure, and the third intermediate pressure is higher than the second intermediate pressure.

5. The air conditioner of claim 3, wherein the bypass flow path extends from a branching unit of the third injection flow path to the suction unit.

6. The air conditioner of claim 5, further comprising a bypass valve provided in the bypass flow path.

7. The air conditioner of claim 6, further comprising an injection valve provided in the third injection flow path.

8. The air conditioner of claim 7, wherein the bypass valve is closed and the injection valve is opened during a heating operation.

9. The air conditioner of claim 7, wherein the bypass valve is opened and the injection valve is closed during a cooling operation.

10. The air conditioner of claim 1, wherein the plurality of refrigerant separation devices include an internal heat exchanger, a first phase separator, and a second phase separator.

11. The air conditioner of claim 1, wherein the first inlet is provided at a position in which an extension line coupling a center portion of the fixed scroll to a center portion of the suction unit is rotated in a direction opposite to a direction of rotation of the compression chamber by a first set angle ($\theta 1$).

12. The air conditioner of claim 11, wherein the first set angle ($\theta 1$) is 61° to 101°.

13. The air conditioner of claim 1, wherein the second inlet is provided at a position which is rotated in a direction of rotation of the compression chamber from a position of the first inlet by a second set angle ($\theta 2$).

14. The air conditioner of claim 13, wherein the second set angle ($\theta 2$) is 130° to 150°.

15. The air conditioner of claim 1, wherein the third inlet is provided at a position which is rotated in a direction of rotation of the compression chamber from a position of the first inlet by a third set angle ($\theta 3$).

16. The air conditioner of claim 15, wherein the third set angle ($\theta 3$) is 260° to 300°.

17. An air conditioner comprising:

a compressor to compress a refrigerant, the compressor having a suction unit;

an inside heat exchanger into which the compressed refrigerant is introduced during a heating operation;

an outside heat exchanger into which the compressed refrigerant is introduced during a cooling operation;

a plurality of internal heat exchangers through which a refrigerant condensed in the inside heat exchanger or the outside heat exchanger pass;

a first injection flow path coupled to a first internal heat exchanger of the plurality of internal heat exchangers to inject a refrigerant into the compressor;

a second injection flow path coupled to a second internal heat exchanger of the plurality of internal heat exchangers to inject a refrigerant into the compressor;

a third injection flow path coupled to a third internal heat exchanger of the plurality of internal heat exchangers to inject a refrigerant into the compressor; and a bypass flow path that extends from the third injection flow path to the suction unit.

18. The air conditioner of claim 17, further comprising:

a bypass valve provided in the bypass flow path; and an injection valve provided in the third injection flow path, wherein the bypass valve is closed and the injection valve is opened during a heating operation, and the bypass valve is opened and the injection valve is closed during a cooling operation.

19. The air conditioner of claim 17, wherein the compressor includes a scroll compressor having a fixed scroll and an orbiting scroll, and the scroll compressor includes:

a first inlet provided at a first side of the fixed scroll to inject a refrigerant into a compression chamber;

a second inlet provided at a second side of the fixed scroll to inject a refrigerant having a different pressure from the refrigerant injected into the first inlet into the compression chamber; and a third inlet provided at a third side of the fixed scroll to inject a refrigerant having a different pressure from the refrigerant injected into the first and second inlets into the compression chamber.

* * * * *